US009879205B2

(12) United States Patent
Liang et al.

(10) Patent No.: US 9,879,205 B2
(45) Date of Patent: Jan. 30, 2018

(54) LOW FOAMING AND HIGH STABILITY HYDROTROPE FORMULATION COMPRISING AN ALKYL GLUCOSIDE HAVING EIGHT OR FEWER CARBON ATOMS

(71) Applicant: DOW GLOBAL TECHNOLOGIES LLC, Midland, MI (US)

(72) Inventors: Bing Liang, Shanghai (CN); Jianhai Mu, Shanghai (CN)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 15/302,742

(22) PCT Filed: May 9, 2014

(86) PCT No.: PCT/CN2014/077114

§ 371 (c)(1),
(2) Date: Oct. 7, 2016

(87) PCT Pub. No.: WO2015/168921

PCT Pub. Date: Nov. 12, 2015

(65) Prior Publication Data

US 2017/0107454 A1 Apr. 20, 2017

(51) Int. Cl.

| | |
|---|---|
| ***C11D 1/722*** | (2006.01) |
| ***C11D 1/83*** | (2006.01) |
| ***C11D 3/22*** | (2006.01) |
| ***C11D 1/34*** | (2006.01) |
| ***C11D 1/66*** | (2006.01) |
| ***C11D 3/00*** | (2006.01) |
| *C11D 3/37* | (2006.01) |

(52) U.S. Cl.

CPC ..... *C11D 1/83* (2013.01); *C11D 1/345* (2013.01); *C11D 1/662* (2013.01); *C11D 3/0026* (2013.01); *C11D 3/3707* (2013.01)

(58) Field of Classification Search

CPC ..... C11D 3/0026; C11D 1/345; C11D 1/722; C11D 1/83; C11D 3/22; C11D 3/362; C11D 3/3707

See application file for complete search history.

(56) References Cited

U.S. PATENT DOCUMENTS

| | | | | |
|---|---|---|---|---|
| 4,137,190 | A | 1/1979 | Chakrabarti et al. | |
| 5,192,461 | A * | 3/1993 | Tomaszewski | C11D 3/044 510/245 |
| 7,781,388 | B2 * | 8/2010 | Heintz | C11D 1/825 510/238 |
| 8,278,260 | B2 | 10/2012 | Saint Victor | |
| 2003/0151022 | A1 * | 8/2003 | Bragulla | B01D 19/0404 252/60 |
| 2009/0076299 | A1 * | 3/2009 | Company | A01N 25/30 562/20 |

OTHER PUBLICATIONS

International Search Report & Written Opinion for related PCT Application PCT/CN2014/077114, dated Feb. 11, 2015 (12 pgs).

* cited by examiner

*Primary Examiner* — Charles Boyer
(74) *Attorney, Agent, or Firm* — Brooks, Cameron & Huebsch, PLLC

(57) ABSTRACT

An aqueous solution contains a nonionic surfactant, a alkyl phenoxy polyethoxy phosphate and an alkyl glucoside selected from a group consisting of alkyl glucosides characterized by the alkyl group having eight or fewer carbons and when the alkyl group has eight carbons it is a branched alkyl having a linear six carbon chain with a two carbon branch, where the aqueous solution is further characterized by containing less than 0.3 weight-percent cumene sulfonic acid or its alkali salt based on total aqueous solution weight and the alkyl glucoside is present at a concentration greater than alkyl glucosides having an alkyl group with more than eight carbons, as well as its uses for increasing the cloud point and decreasing the foaming properties.

12 Claims, 3 Drawing Sheets

LOW FOAMING AND HIGH STABILITY HYDROTROPE FORMULATION COMPRISING AN ALKYL GLUCOSIDE HAVING EIGHT OR FEWER CARBON ATOMS

BACKGROUND OF THE INVENTION

Field of the Invention

The present invention relates to an aqueous solution containing a nonionic surfactant and a hydrotrope containing an alkyl phenoxy polyethoxy phosphate and an alkyl glucoside.

Introduction

A challenge with aqueous cleaning formulations is achieving stability of the formulation in a range of environments and temperatures, desirably while at the same time minimizing foaming. A cleaning formulation often contains one or more nonionic surfactants and may further contain a base such as sodium hydroxide or potassium hydroxide and other electrolytes. Electrolytes decrease the solubility of nonionic surfactants and result in destabilization of the formulation. Likewise, increase temperatures tend to destabilize the formulation by decreasing the solubility of the nonionic surfactants. Often, a hydrotrope is included in the formulation to enhance solubility of the nonionic surfactants and improve formulation stability over temperature and electrolyte concentration ranges of interest.

It is desirable to maximize the efficiency of hydrotropes that are included in cleaning formulations. That is, it is desirable to identify a hydrotrope that maximizes cloud point temperature of an aqueous cleaning formulation containing nonionic surfactant and electrolytes for a given concentration of hydrotrope. The cloud point temperature is the temperature at which one or more than one component of a solution is no longer completely soluble in the solution and reveals at what temperature the solution becomes unstable. Higher cloud point temperatures indicate higher stability.

It is further desirable to minimize foaming of the cleaning formulation in many applications. Processes that require circulation of cleaning formulations are inhibited by foaming, which can cause variation in the rate of formulation circulation and even cause the circulation to shut down. Foaming can also cause overflow in containers holding cleaning formulations.

Therefore, it is desirable to identify a formulation that maximizes cloud point temperature and, desirably, minimizes foaming for an aqueous cleaning solution containing a nonionic surfactant by maximizing the efficiency of a hydrotrope in the formulation.

BRIEF SUMMARY OF THE INVENTION

The present invention is a result of discovering a combination of additives that serves as a hydrotrope that synergistically increases the cloud point temperature of an aqueous nonionic surfactant solution even in the presence of electrolytes and that can reduce the foaming properties of the solution.

In particular, the present invention is a result of discovering that alkyl phenoxy polyethoxy phosphate in combination with an alkyl glucoside characterized by having an alkyl group having eight or fewer carbons synergistically increase the cloud point temperature of an aqueous nonionic surfactant solution even in the presence of electrolytes while at the same time reducing the foaming properties of the solution.

Desirably, the alkyl group is a linear six carbon alkyl chain or a linear six carbon alkyl chain with a two carbon branch.

In a first aspect, the present invention is an aqueous solution comprising a nonionic surfactant, a alkyl phenoxy polyethoxy phosphate and an alkyl glucoside selected from a group consisting of alkyl glucosides characterized by the alkyl group having eight or fewer carbons and when the alkyl group has eight carbons it is a branched alkyl having a linear six carbon chain with a two carbon branch, where the aqueous solution is further characterized by containing less than 0.3 weight-percent cumene sulfonic acid or its alkali salt based on total aqueous solution weight and the alkyl glucoside is present at a concentration greater than alkyl glucosides having an alkyl group with more than eight carbons.

In a second aspect, the present invention is a process for increasing the cloud point and decreasing the foaming properties of an aqueous nonionic surfactant solution, the process comprising combining in an aqueous continuous phase to form a solution the following components: a nonionic surfactant, an alkyl phenoxy polyethoxy phosphate and an alkyl glucoside selected from a group consisting of alkyl glucoside characterized by the alkyl group having eight or fewer carbons and when the alkyl group has eight carbons it is a branched alkyl having a linear six carbon chain with a two carbon branch, where the aqueous solution is further characterized by containing less than 0.3 weight-percent cumene sulfonic acid or its alkali salt based on total aqueous solution weight and whereas the alkyl glucoside is combined at a concentration greater than any alkyl glucoside having an alkyl group with more than eight carbons.

The process of the present invention is useful for preparing the aqueous solution of the present invention. The aqueous solution of the present invention is useful as a cleaning solution.

DETAILED DESCRIPTION OF THE INVENTION

Figure 1:
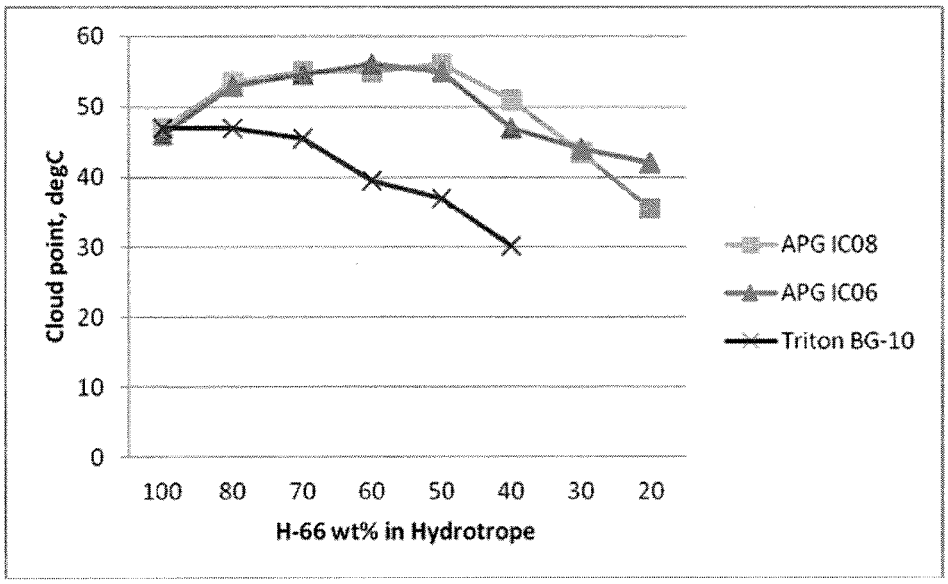
FIG. 1 is a plot of the data in Table 1.

All ranges include endpoints unless otherwise stated. "And/or" means "and, or alternatively". "Miscible" means able to be mixed together at a molecular level.

Test methods refer to the most recent test method as of the priority date of this document unless a date is indicated with the test method number as a hyphenated two digit number. References to test methods contain both a reference to the testing society and the test method number. Test method organizations are referenced by one of the following abbreviations: ASTM refers to ASTM International (formerly known as American Society for Testing and Materials); EN refers to European Norm; DIN refers to Deutsches Institut für Normung; and ISO refers to International Organization for Standards.

"Mw" refers to weight average molecular weight and "Mn" refers to number average molecular weight. Determine molecular weight values and conduct molecular weight analysis herein using gel permeation chromatography (GPC). Conduct GPC analysis using an Agilent 1100 Series GPC by dissolving 0.10 grams of sample in 10 milliliters of tetrahydrofuran (THF) and inject 50 microliters of the resulting solution onto a series of two Polymer Labs PLgel 5 micrometer MIXED-E columns (330×7.5 millimeter) and eluting with THF at a flow rate of 1.0 milliliters per minute at 35 degrees Celsius (° C.). A conventional calibration curve is generated using narrow polyethylene glycol standards.

The hydrotrope of the present invention is a combination of an alkyl phenoxy polyethoxy phosphate and an alkyl glucoside. The present invention relates to an aqueous solution that comprises a nonionic surfactant and the hydrotrope, that is, an alkyl phenoxy polyethoxy phosphate and an alkyl glucoside. The aqueous solution is further characterized by containing less than 0.3 weight-percent (wt %) cumene sulfonic acid or its alkali salt based on total aqueous solution weight.

The nonionic surfactant is typically a polyalkylene oxide and more typically a copolymer of different alkylene oxides. For example, the nonionic surfactant can be a polymer comprising ethylene oxide moieties, propylene oxide moieties, butylene oxide moieties or any combination thereof. A common nonionic surfactant for use in the present invention is a block copolymer of ethylene oxide and propylene oxide, including diblock copolymers and triblock copolymers. An ethylene oxide/propylene oxide/ethylene oxide triblock copolymer is a particularly desirable nonionic surfactant for use in the present invention. The nonionic surfactant is typically present in the aqueous solution at a concentration of 0.5 wt % or more, preferably one wt % or more, more preferably three wt % or more, yet more preferably five wt % or more and can be eight wt % or more while at the same time is typically 15 wt % or less, preferably 10 wt % or less and can be eight wt % or less based on total weight of the aqueous solution.

The alkyl phenoxy polyethoxy phosphate is desirably in salt form, and more desirably a potassium salt. Desirably, the alkyl phenoxy polyethoxy phosphate has two or more ethoxy units and at the same time generally has ten or fewer and preferably five or fewer ethoxy units in the polyethoxy component. One particularly desirable potassium salt of an alkyl phenoxy polyethoxy phosphate is a meta methyl phenol polyethoxy phosphate with approximately five ethylene oxide units available commercially under the trade name TRITON™ H-66 (TRITON is a trademark of The Dow Chemical Company). The alkyl phenoxy polyethoxy phosphate is typically present in the aqueous solution at a concentration of less than 20 wt %, preferably 15 wt % or less, more preferably 10 wt % or less and generally five wt % or less and can be four wt % or less, three wt % or less and even two wt % or less while at the same time is typically present at a concentration of 0.1 wt % or more, generally 0.5 wt % or more and more typically 0.75 wt % or more and preferably one wt % or more based on total aqueous solution weight.

The alkyl glucoside is characterized by the alkyl group having eight or fewer carbons and when the alkyl group has eight carbons it is a branched alkyl having a linear six carbon chain with a two carbon branch. At the same time, the alkyl group typically has four or more carbons, preferably five or more carbons and most preferably has six carbons or more. Preferably, the alkyl group is selected from a group consisting of a linear six carbon alkyl chain and a linear six carbon alkyl chain with a two carbon branch. Even more preferably, the alkyl group is a linear six carbon alkyl chain. If alkyl glucosides having an alkyl group with more than eight carbons are present, the concentration of alkyl glucoside with an alkyl group of eight carbons or less is greater than the concentration of alkyl glucosides having an alkyl group with more than eight carbons. Desirably, the present invention is free of alkyl glucosides having an alkyl group of more than eight carbons.

The alkyl glucoside can have one or more than one glucoside unit. For example, the alkyl glucoside can be a polyglucoside having two or more and can have three or more glucoside groups while at the same time typically has five or fewer, preferably four or fewer, more preferably three or fewer. Most preferably, the alkyl glucoside has on average 1.2 to 2 glucoside units per molecule. Examples of particularly desirable alkyl glucosides include those having on average 1.2 to 2 glucoside units per molecule and a linear six carbon alkyl chain (such as that sold under the trade name GREEN APG IC 06) and those having on average 1.2 to 2 glucoside units per molecule and an eight carbon alkyl group with a linear six carbon chain and a two carbon branch (such as that sold under the trade name GREEN APG IC 08).

The concentration of alkyl glucoside in the aqueous solution is typically 0.05 wt % or more, preferably 0.1 wt % or more, more preferably 0.5 wt % or more, even more preferably one wt % or more, yet even more preferably two wt % or more and can be three wt % or more, four wt % or more, five wt % or more, six wt % or more and even seven wt % or more while at the same time is typically 15 wt % or less, and generally 10 wt % or less and can be nine wt % or less, eight wt % or less, seven wt % or less, six wt % or less and even five wt % or less based on total aqueous solution weight.

The hydrotrope of the present invention surprisingly demonstrates synergistic efficacy at stabilizing the aqueous nonionic surfactant solution as evidenced by an increase in cloud point temperature. The synergy is evident by achieving a higher cloud point temperature than a hydrotrope of either the alkyl phenoxy polyethoxy phosphate or alkyl glucoside alone. Desirably, the concentration of alkyl phenoxy polyethoxy phosphate in the hydrotrope is less than 100 wt % and can be 95 wt % or less, 90 wt % or less, 80 wt % or less, 70 wt % or less, 60 wt % or less and even 50 wt % or less while at the same time is preferably 30 wt % or more, more preferably 40 wt % or more and can be 50 wt % or more, 60 wt % or more, 70 wt % or more and even 80 wt % or more with wt % based on combined weight of the alkyl phenoxy polyethoxy phosphate and alkyl glucoside.

Moreover, the hydrotrope of the present invention demonstrates synergistically lower foaming properties than either component alone. Even more, the hydrotrope of the present invention demonstrates lower foaming properties than either TRITON BG-10 alkyl glucoside alone or in combination with the alkyl phenoxy polyethoxy phosphate of the hydrotrope formulation of the present invention.

Hence, the hydrotrope formulation of the present invention surprisingly synergistically increases the cloud point temperature of an aqueous nonionic surfactant solution containing a hydrotrope even in the presence of electrolytes while at the same time reducing the foaming properties of the solution.

The aqueous solution of the present invention results from the process of the present invention for increasing the cloud point and decreasing the foaming properties of an aqueous nonionic surfactant solution. The process of the present invention comprises combining in an aqueous continuous phase to form a solution the following components: a nonionic surfactant, an alkyl phenoxy polyethoxy phosphate and an alkyl glucoside selected from a group consisting of alkyl glucoside characterized by the alkyl group having eight or fewer carbons and when the alkyl group has eight carbons it is a branched alkyl having a linear six carbon chain with a two carbon branch, where the aqueous solution is further characterized by containing less than 0.3 weight-percent cumene sulfonic acid or its alkali salt based on total aqueous solution weight and whereas the alkyl glucoside is combined at a concentration greater than any alkyl glucoside having an alkyl group with more than eight carbons. The nonionic surfactant, alkyl phenoxy polyethoxy phosphate and alkyl glucoside are as described above. The aqueous solution produced in the process of the present invention is as described above.

EXAMPLES

Electrolyte-Containing Low Foam Spray Cleaning Formulation

Prepare an aqueous solution consisting of 65 wt % water, 10 wt % sodium hydroxide solution (50 wt % aqueous solution), eight wt % of an ethylene oxide/propylene oxide/ethylene oxide block copolymer having a weight average molecular weight of approximately 1750 grams per mole and ethylene oxide making up approximately 30 wt % of the block copolymer (for example, TERGITOL™ L-62 polyether polyol nonionic surfactant (TERGITOL is a trademark of The Dow Chemical Company)), four wt % sodium carbonate, three wt % sodium metasilicate and 10 wt % of a hydrotrope identified in Table 1, with wt % based on total aqueous solution weight.

Determine the Cloud Point Temperature for each sample in Table 1 according to the following Cloud Point Temperature characterization procedure:

Cloud Point Temperature

Introduce 10 milliliters of the sample solution into a transparent glass tube that is 15 millimeters in diameter and 150 millimeters in length. Heat the sample gently in a water bath at a temperature of 80 degrees Celsius (° C.) while stirring the contents with a glass thermometer until the solution becomes cloudy. Remove the sample from the water bath and allow to cool. Record as the Cloud Point Temperature that temperature where the solution becomes clear again.

Table 1 contains the Cloud Point Temperature for each of the samples. The data in Table 1 reveals a synergistic stabilization of the solution when the alkyl phenoxy polyethoxy phosphate and alkyl glucoside having eight or fewer alkyl carbons is used as a hydrotrope. The synergistic stabilization is evident by achieving a higher Cloud Point Temperature than a hydrotrope of either the alkyl phenoxy polyethoxy phosphate or alkyl glucoside alone. The importance of the alkyl chain length in the alkyl glucoside is evident from the lack of synergistic effect with hydrotropes using TRITON BG-10. FIG. 1 provides a plot of the data in Table 1.

Figure 2:
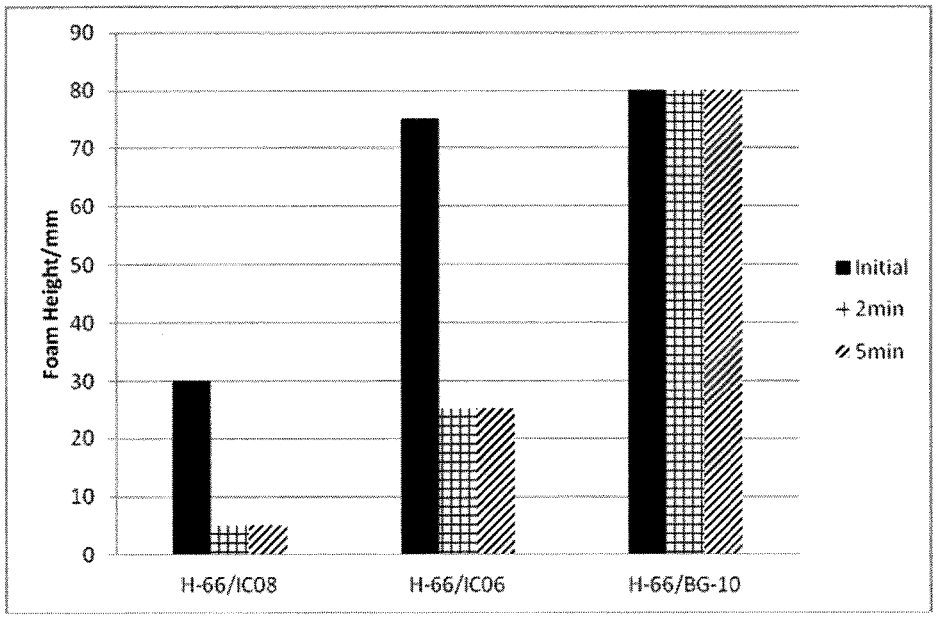
FIG. 2 is a plot of the data in Table 2.

The samples with 50 wt % H-66 and 50 wt % alkyl glucoside (Ex 4, Ex 11 and comp Ex G) were further characterized for their foaming characteristics. A test solution of 5 wt % of the sample solution in deionized water was subjected to the Ross-Mills Foam Test (as set forth in ASTM D1173) with results presented in Table 2 and FIG. 2.

The results from the Ross-Mills Foam Test reveal that the aqueous solution of the present invention have a lower foam height and foam retention than the comparative example solution.

TABLE 1

| | Hydrotrope Composition | | | | |
|---|---|---|---|---|---|
| Sample | H-66[a] (wt %) | APG IC06[b] (wt %) | APG IC08[c] (wt %) | BG-10[d] (wt %) | Cloud Point Temperature (° C.) |
| Comp Ex A | 100 | 0 | 0 | 0 | 47 |
| Ex 1 | 80 | 20 | 0 | 0 | 53 |
| Ex 2 | 70 | 30 | 0 | 0 | 54.5 |
| Ex 3 | 60 | 40 | 0 | 0 | 56 |
| Ex 4 | 50 | 50 | 0 | 0 | 55 |
| Ex 5 | 40 | 60 | 0 | 0 | 47 |
| Ex 6 | 30 | 70 | 0 | 0 | 44 |
| Ex 7 | 20 | 80 | 0 | 0 | 42 |
| Comp Ex B | 0 | 100 | 0 | 0 | S* |
| Ex 8 | 80 | 0 | 20 | 0 | 53.5 |
| Ex 9 | 70 | 0 | 30 | 0 | 55 |
| Ex 10 | 60 | 0 | 40 | 0 | 55 |
| Ex 11 | 50 | 0 | 50 | 0 | 56 |
| Ex 12 | 40 | 0 | 60 | 0 | 51 |
| Ex 13 | 30 | 0 | 70 | 0 | 43.5 |
| Ex 14 | 20 | 0 | 80 | 0 | 35.5 |
| Comp Ex C | 0 | 0 | 100 | 0 | S* |
| Comp Ex D | 80 | 0 | 0 | 20 | 47 |
| Comp Ex E | 70 | 0 | 0 | 30 | 45.5 |
| Comp Ex F | 60 | 0 | 0 | 40 | 39.5 |
| Comp Ex G | 50 | 0 | 0 | 50 | 37 |
| Comp Ex H | 40 | 0 | 0 | 60 | 30 |
| Comp Ex I | 30 | 0 | 0 | 70 | S* |
| Comp Ex J | 20 | 0 | 0 | 80 | S* |
| Comp Ex K | 0 | 0 | 0 | 100 | S* |

[a]H-66 refers to TRITON H-66 alkyl phenoxy polyethoxy phosphate, potassium salt

[b]APG IC06 refers to GREEN APG IC 06 alkyl glucoside having a linear 6-carbon alkyl group.

[c]APG IC08 refers to GREEN APG IC 08 alkyl glucoside having an eight-carbon alkyl group that is a six-carbon linear chain with a two-carbon pendant group.

[d]BG-10 refers to TRITON BG-10 alkyl glucoside which comprising materials with a blend of 8 and 10 carbon alkyl groups.

*S indicates the formulation phase separates and is completely unstable as a solution at any temperature tested.

TABLE 2

| | Foam Height (millimeters) | | |
|---|---|---|---|
| Sample | Initial | 2 Minute | 5 Minute |
| Ex 4 | 75 | 25 | 25 |
| Ex 11 | 30 | 5 | 5 |
| Comp Ex G | 80 | 80 | 80 |

Lower Electrolyte, High Base Formulation

Figure 3:
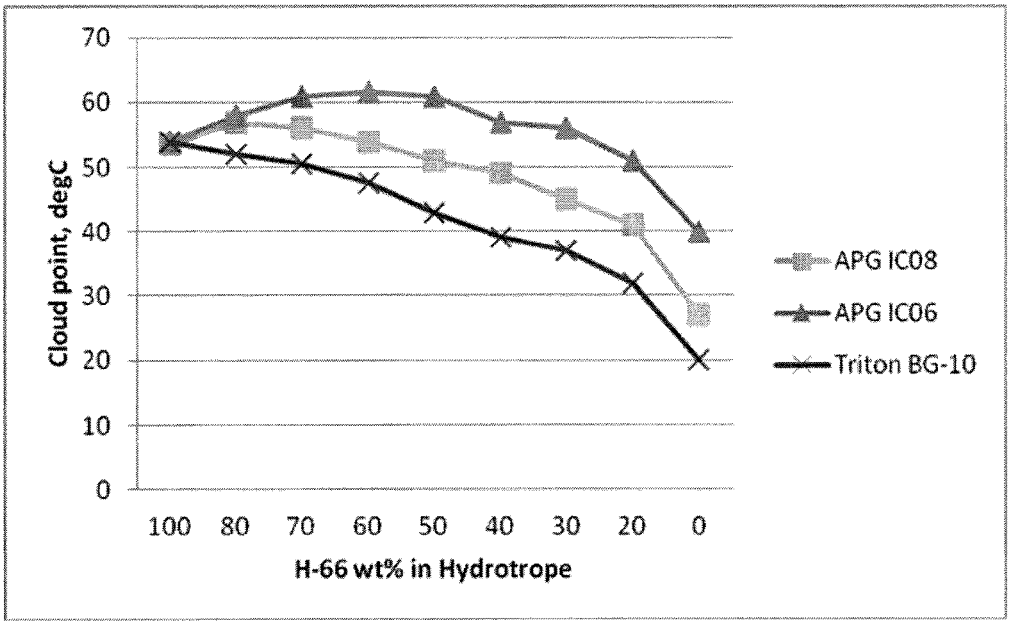
FIG. 3 is a plot of the data in Table 3.

Prepare an aqueous solution consisting of 76 wt % water, 20 wt % sodium hydroxide solution (50 wt % aqueous solution), one wt % TERGITOL™ L-62 polyether polyol nonionic surfactant (TERGITOL is a trademark of The Dow Chemical Company) and three wt % of a hydrotrope identified in Table 3 with wt % based on total aqueous solution weight. Determine the Cloud Point Temperature for each sample in Table 3 using the Cloud Point Temperature characterization procedure described above. Results are in Table 3 and FIG. 3.

The results reveal a synergistic increase in stabilization of the aqueous solution when the alkyl phenoxy polyethoxy phosphate and alkyl glucoside having eight or fewer alkyl carbons is used as a hydrotrope. The synergistic stabilization is evident by achieving a higher Cloud Point Temperature than a hydrotrope of either the alkyl phenoxy polyethoxy phosphate or alkyl glucoside alone. The importance of the alkyl chain length in the alkyl glucoside is evident from the lack of synergistic effect with hydrotropes using TRITON BG-10.

TABLE 3

| Sample | Hydrotrope Composition H-66[a] (wt %) | APG IC06[b] (wt %) | APG IC08[c] (wt %) | BG-10[d] (wt %) | Cloud Point Temperature (° C.) |
|---|---|---|---|---|---|
| Comp Ex L | 100 | 0 | 0 | 0 | 53.5 |
| Ex 15 | 80 | 20 | 0 | 0 | 58 |
| Ex 16 | 70 | 30 | 0 | 0 | 61 |
| Ex 17 | 60 | 40 | 0 | 0 | 61.5 |
| Ex 18 | 50 | 50 | 0 | 0 | 61 |
| Ex 19 | 40 | 60 | 0 | 0 | 57 |
| Ex 20 | 30 | 70 | 0 | 0 | 56 |
| Ex 21 | 20 | 80 | 0 | 0 | 51 |
| Comp Ex M | 0 | 100 | 0 | 0 | 40 |
| Ex 22 | 80 | 0 | 20 | 0 | 57 |
| Ex 23 | 70 | 0 | 30 | 0 | 56 |
| Ex 24 | 60 | 0 | 40 | 0 | 54 |
| Ex 25 | 50 | 0 | 50 | 0 | 51 |
| Ex 26 | 40 | 0 | 60 | 0 | 49 |
| Ex 27 | 30 | 0 | 70 | 0 | 45 |
| Ex 28 | 20 | 0 | 80 | 0 | 41 |
| Comp Ex N | 0 | 0 | 100 | 0 | 27 |
| Comp Ex O | 80 | 0 | 0 | 20 | 52 |
| Comp Ex P | 70 | 0 | 0 | 30 | 50.5 |
| Comp Ex Q | 60 | 0 | 0 | 40 | 47.5 |
| Comp Ex R | 50 | 0 | 0 | 50 | 43 |
| Comp Ex S | 40 | 0 | 0 | 60 | 39 |
| Comp Ex T | 30 | 0 | 0 | 70 | 37 |
| Comp Ex U | 20 | 0 | 0 | 80 | 32 |
| Comp Ex V | 0 | 0 | 0 | 100 | 20 |

[a]H-66 refers to TRITON H-66 alkyl phenoxy polyethoxy phosphate, potassium salt
[b]APG IC06 refers to GREEN APG IC 06 alkyl glucoside having a linear 6-carbon alkyl group.
[c]APG IC08 refers to GREEN APG IC 08 alkyl glucoside having an eight-carbon alkyl group that is a six-carbon linear chain with a two-carbon pendant group.
[d]BG-10 refers to TRITON BG-10 alkyl glucoside which comprising materials with a blend of eight and 10 carbon alkyl groups.
*S indicates the formulation phase separates and is completely unstable as a solution at any temperature tested.

Lower Electrolyte, High Base Formulation Different Nonionic Surfactant

Figure 5:
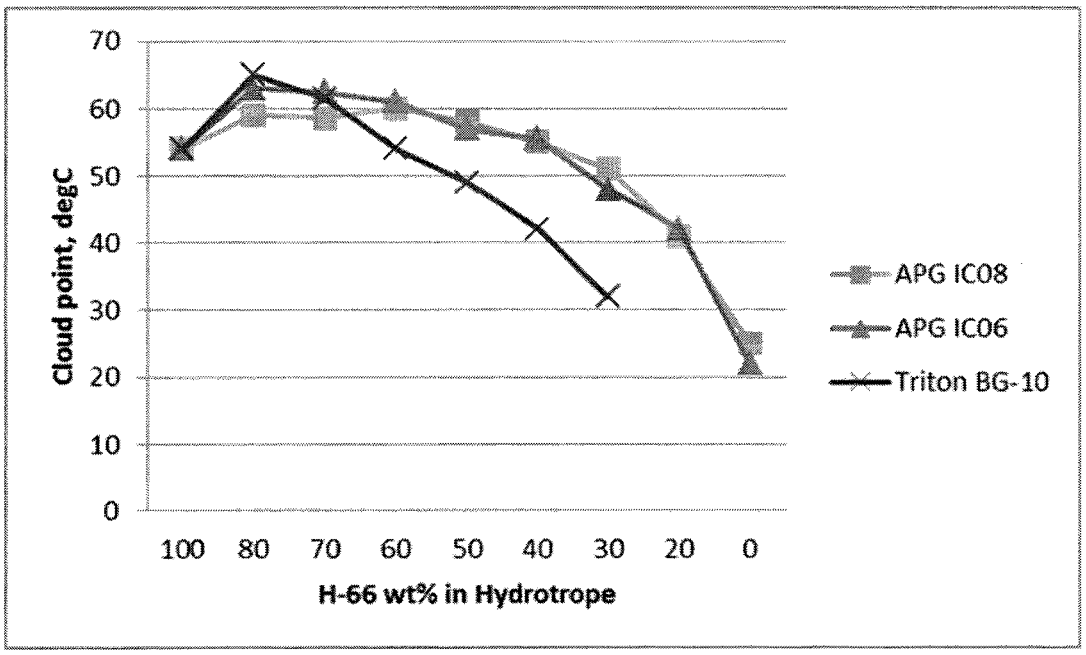
FIG. 5 is a plot of the data in Table 5.

Prepare an aqueous solution consisting of 74 wt % water, 20 wt % sodium hydroxide solution (50 wt % aqueous solution), two wt % of an ethylene oxide/propylene oxide/ethylene oxide block copolymer having a weight average molecular weight of approximately 2700 grams per mole and ethylene oxide making up approximately 40 wt % of the block copolymer (for example, TERGITOL™ L-64 polyether polyol nonionic surfactant (TERGITOL is a trademark of The Dow Chemical Company)) and four wt % of a hydrotrope identified in Table 5, with wt % based on total aqueous solution weight. Determine the Cloud Point Temperature for each sample in Table 5 using the Cloud Point Temperature characterization procedure described above. Results are in Table 5, below, and FIG. 5.

The results reveal a synergistic increase in stabilization of the aqueous solution when the alkyl phenoxy polyethoxy phosphate and alkyl glucoside is used as a hydrotrope. The synergistic stabilization is evident by achieving a higher Cloud Point Temperature than a hydrotrope of either the alkyl phenoxy polyethoxy phosphate or alkyl glucoside alone.

General Foaming Performance of Hydrotropes in Water

Figure 4:
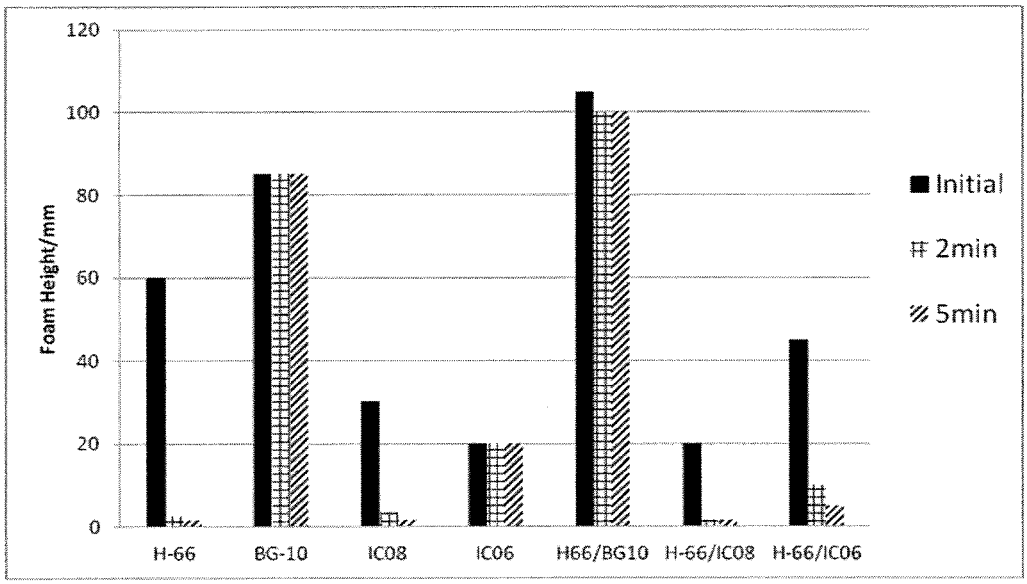
FIG. 4 is a plot of the data in Table 4.

Evaluate general foaming characteristics of hydrotropes by preparing an aqueous solution containing 0.1 wt % of the hydrotrope and subjecting that aqueous solution to the Ross-Mills Foam Test described above. The hydrotropes and results are in Table 4, below, and FIG. 4. Results show that hydrotropes of alkyl phenoxy polyethoxy phosphate and alkyl glucoside having eight or fewer alkyl carbons synergistically reduce foaming properties of the aqueous solution as evidenced by lower foam heights for the combination of components over the individual components alone. The importance of the alkyl chain length in the alkyl glucoside is evident from an apparent synergistic increase in foam height with TRITON BG-10.

TABLE 4

| Hydrotrope Composition | Foam Height (millimeters) Initial | 2 Minute | 5 Minute |
|---|---|---|---|
| H-66 | 60 | 2.5 | 1.5 |
| IC06 | 20 | 20 | 20 |
| 50/50 H-66/IC06 | 45 | 10 | 5 |
| IC08 | 30 | 3.5 | 1.5 |
| 50/50 H-66/IC08 | 20 | 1.5 | 1.5 |
| BG-10 | 85 | 85 | 85 |
| 50/50 H-66/BG-10 | 105 | 100 | 100 |

TABLE 5

| Sample | Hydrotrope Composition H-66[a] (wt %) | APG IC06[b] (wt %) | APG IC08[c] (wt %) | BG-10[d] (wt %) | Cloud Point Temperature (° C.) |
|---|---|---|---|---|---|
| Comp Ex W | 100 | 0 | 0 | 0 | 54 |
| Ex 29 | 80 | 20 | 0 | 0 | 63 |
| Ex 30 | 70 | 30 | 0 | 0 | 62.5 |
| Ex 31 | 60 | 40 | 0 | 0 | 61 |
| Ex 32 | 50 | 50 | 0 | 0 | 57 |
| Ex 33 | 40 | 60 | 0 | 0 | 55.5 |
| Ex 34 | 30 | 70 | 0 | 0 | 48 |
| Ex 35 | 20 | 80 | 0 | 0 | 42 |
| Comp Ex X | 0 | 100 | 0 | 0 | 22 |
| Ex 36 | 80 | 0 | 20 | 0 | 59 |
| Ex 37 | 70 | 0 | 30 | 0 | 58.5 |
| Ex 38 | 60 | 0 | 40 | 0 | 60 |
| Ex 39 | 50 | 0 | 50 | 0 | 58 |
| Ex 40 | 40 | 0 | 60 | 0 | 55 |
| Ex 41 | 30 | 0 | 70 | 0 | 51 |
| Ex 42 | 20 | 0 | 80 | 0 | 41 |
| Comp Ex Y | 0 | 0 | 100 | 0 | 25 |
| Comp Ex Z | 80 | 0 | 0 | 20 | 60 |
| Comp Ex AA | 70 | 0 | 0 | 30 | 65 |
| Comp Ex BB | 60 | 0 | 0 | 40 | 61.5 |
| Comp Ex CC | 50 | 0 | 0 | 50 | 54 |
| Comp Ex DD | 40 | 0 | 0 | 60 | 49 |
| Comp Ex EE | 30 | 0 | 0 | 70 | 42 |
| Comp Ex FF | 20 | 0 | 0 | 80 | 32 |
| Comp Ex GG | 0 | 0 | 0 | 100 | S* |

[a]H-66 refers to TRITON H-66 alkyl phenoxy polyethoxy phosphate, potassium salt
[b]APG IC06 refers to GREEN APG IC 06 alkyl glucoside having a linear 6-carbon alkyl group.
[c]APG IC08 refers to GREEN APG IC 08 alkyl glucoside having an eight-carbon alkyl group that is a six-carbon linear chain with a two-carbon pendant group.
[d]BG-10 refers to TRITON BG-10 alkyl glucoside which comprising materials with a blend of eight and 10 carbon alkyl groups.
*S indicates the formulation phase separates and is completely unstable as a solution at any temperature tested.

What is claimed is:

1. An aqueous solution comprising:

a) an alkyl phenoxy polyethoxy phosphate;

b) an alkyl glucoside selected from the group consisting of alkyl glucosides characterized by the alkyl group having eight or fewer carbons, and when the alkyl group has eight carbons, it is a branched alkyl having a linear six carbon chain with a two carbon branch; and c) a nonionic surfactant different from component b, wherein the aqueous solution is further characterized by containing less than 0.3 weight-percent cumene sulfonic acid or its alkali salt based on the total aqueous solution weight, and the alkyl glucoside having eight or fewer carbon atoms is present at a concentration greater than alkyl glucosides having an alkyl group with more than eight carbons atoms, if said alkyl glucosides are present.

2. The aqueous solution of claim 1, where the concentration of alkyl phenoxy polyethoxy phosphate is less than 100 weight-percent and 40 weight-percent or more based on the combined weight of alkyl phenoxy polyethoxy phosphate and alkyl glucoside.

3. The aqueous solution of claim 1, further characterized by the aqueous solution being free of alkyl glucosides having alkyl groups containing more than eight carbons.

4. The aqueous solution of claim 1, further characterized by the glucoside being selected from the group consisting of alkyl glucosides characterized by their alky group having a linear six carbon alkyl chain or a linear six carbon alkyl chain with a two carbon branch.

5. The aqueous solution of claim 1, further characterized by the alkyl group of the glucoside having six or fewer carbons.

6. The aqueous solution of claim 1, further characterized by the nonionic surfactant being a copolymer of ethylene oxide and propylene oxide.

7. The aqueous solution of claim 1, further comprising an electrolyte.

8. A process for increasing the cloud point and decreasing the foaming properties of an aqueous nonionic surfactant solution comprising combining in an aqueous continuous phase to form a solution the following components:

a) an alkyl phenoxy polyethoxy phosphate;

b) an alkyl glucoside selected from the group consisting of alkyl glucosides characterized by the alkyl group having eight or fewer carbons, and when the alkyl group has eight carbons, it is a branched alkyl having a linear six carbon chain with a two carbon branch; and c) a nonionic surfactant different from component b, wherein the aqueous solution is further characterized by containing less than 0.3 weight-percent cumene sulfonic acid or its alkali salt based on the total aqueous solution weight, and the alkyl glucoside having eight or fewer carbon atoms is present at a concentration greater than alkyl glucosides having an alkyl group with more than eight carbons atoms, if said alkyl glucosides are present.

9. The process of claim 8, further characterized by the glucoside being selected from the group consisting of alkyl glucosides characterized by their alky group having a linear six carbon alkyl chain or a linear six carbon alkyl chain with a two carbon branch.

10. The process of claim 8, further characterized by the alkyl group of the glucoside having six or fewer carbons.

11. The process of claim 8, further characterized by further combining an electrolyte when forming the solution.

12. The process of claim 8, further characterized by the nonionic surfactant being a copolymer of ethylene oxide and propylene oxide.

* * * * *